United States Patent [19]

Ingalls

[11] Patent Number: 4,673,344

[45] Date of Patent: Jun. 16, 1987

[54] SCREW ROTOR MACHINE WITH SPECIFIC LOBE PROFILES

[76] Inventor: Robert A. Ingalls, 349 Highland Rd., Springfield, Vt. 05156

[21] Appl. No.: 808,988

[22] Filed: Dec. 16, 1985

[51] Int. Cl.[4] ..... F04C 18/16

[52] U.S. Cl. ..... 418/201; 418/150

[58] Field of Search ..... 418/150, 201; 74/424.5, 74/458, 459

[56] References Cited

U.S. PATENT DOCUMENTS

| | | | |
|---|---|---|---|
| 4,088,427 | 5/1978 | Emanuelsson | 418/201 |
| 4,350,480 | 9/1982 | Bammert | 418/201 |
| 4,401,420 | 8/1983 | Kasuya | 418/201 |
| 4,435,139 | 3/1984 | Astberg | 418/150 |
| 4,460,322 | 7/1984 | Schibbye | 418/201 |
| 4,508,496 | 4/1985 | Bowman | 418/201 |
| 4,527,967 | 7/1985 | Ingalls | 418/201 |
| 4,576,558 | 3/1986 | Tanaka | 418/201 |
| 4,583,927 | 4/1986 | Shigekawa | 418/201 |

*Primary Examiner*—Carlton R. Croyle

*Assistant Examiner*—Jane E. Obee

*Attorney, Agent, or Firm*—Sughrue, Mion, Zinn, Macpeak, and Seas

[57] ABSTRACT

Helical screw rotors for a screw rotor machine having improved profiles on both male and female rotors, wherein the female rotor leading and trailing flanks comprise first and second circular arcs with the first circular arc subscribed by a first radius whose center lies inside the pitch circle and a second circular arc subscribed by a second radius whose center also lies inside the pitch circle. The leading and trailing flank portions of the male rotor are travel generated by first and second radii on the female rotor resulting in effective driving and driven lobe surfaces on the leading and trailing lobe surfaces. This also results in minimized blowholes and effective sealing surfaces on the intake and discharge sides of the screw rotor machine. The female rotor lobes have a main peripheral surface defined by a true circular arc swung from the axis of the female rotor.

10 Claims, 4 Drawing Figures

SCREW ROTOR MACHINE WITH SPECIFIC LOBE PROFILES

FIELD OF THE INVENTION

This invention relates to screw rotor machines for compression and expansion of a working fluid, such as is explained in co-pending application Ser. No. 815,497 filed on Jan. 2, 1986 by David N. Shaw and entitled "SUPERCHARGER/EXPANDER SYSTEM FOR INTERNAL COMBUSTION ENGINES", and more particularly, to improved screw rotor profiles having effective driving and driven lobe surfaces on male and female rotors in combination with reduced blowhole areas on both leading and trailing flanks.

BACKGROUND OF THE INVENTION

Screw rotor machines employable, both for compression or expansion of an elastic working fluid, have used asymmetric rotor profiles for improved efficiency of the compression or expansion process. The development of asymmetric screw rotor profiles is exemplified by U.S. Pat. Nos. 3,423,017, 4,140,445 and 4,435,139, assigned to Svenska Rotor Machiner: U.S. Pat. Nos. 4,053,263, 4,109,362 and 4,445,831 issued to the present applicant and assigned to Joy Manufacturing Company: U.S. Pat. No. 4,527,967 issued to the present applicant and assigned to Dunham-Bush, Incorporated; and U.S. Pat. Nos. 4,401,420 and 4,406,602 assigned to Hitachi Corporation.

Screw rotor machines, whether functioning as compressors or expanders, are normally of a cast or machined casing or housing bearing two parallel, laterally intersecting cylindrical bores opening at respective ends to high and low pressure ports. Within the bores there are mounted for rotation, interengaging helical screw rotors of the male and female type provided with helical lobes or land and intervening grooves having wrap angles normally less than 300 degrees. Typically, the male rotor is a rotor in which each lobe and groove has at least its major portion located outside the pitch circle of the rotor and has two generally convex flanks located outside the pitch circle, while the female rotor comprises a rotor in which each lobe and groove has at least its major portion located inside the pitch circle of the rotor and has two generally concave flanks located inside the pitch circle of the rotor.

With regard to existing patents covering assymetric screw rotor machines, the blow holes or leakage paths between compression or expansion chambers are relatively small on the discharge side which is controlled by the trailing male and female lobe and groove profiles.

Blowholes on the intake side which are controlled by leading male and female lobe and groove profiles are relatively large.

Driving and driven surfaces on all male drive rotor combinations are located on leading sides of male rotor lobes and female rotor grooves and these surfaces are designed for effective lobe action, without regard for the size of blowholes.

Screw rotor machines functioning as air compressors have previously been used to supercharge internal combustion engines. The relatively large blowholes present on the leading sides of male lobes and female grooves have, however, resulted in excessive leakage, which prevented the recovery of energy which was available due to the expansion of air in the machine.

It is therefore a primary objective of this invention to provide an improved screw rotor machine having improved screw rotor profiles resulting in minimized blowholes on both intake and discharge sides of the machine, effective lobe and groove driving surfaces and improved cutting conditions.

It is comtemplated that this will result in an internal combustion engine supercharger having the ability to act as a compressor when supercharging is required and an expander capable of recovering energy, when intake air, at atmospheric pressure, is expanded to the partial vacuum frequently present in internal combustion engine intake manifolds.

SUMMARY OF THE INVENTION

The invention is directed to the particular profiles of both male and female helical screw rotors for screw rotor machines, such as a compressor or expander or a combination compressor-expander such as is required in an improved internal combustion engine supercharger. The elongated formed female rotor is adapted for rotation about its central longitudinal axis and has a pitch circle centered on the axis and an outer diameter. A plurality of elongated helical lobes exend longitudinally of the rotor and circumferentially spaced about the pitch circle so as to provide intervening grooves therebetween forming addendum portions outside the pitch circle and dedendum portions inside the pitch circle. A major portion of each of the lobes extends generally radially inwardly of the pitch circle and the profile of each of the lobes in a plane perpendicular to the axis has a top portion and respective generally concave leading and trailing portions extending intermediate said tip portion and a root portion of the respective adjacent groove. The lobes of the female rotor engage grooves of the male rotor defined by corresponding helical lobes of the male rotor with contact between the flank portions of respective male and female rotors during the rotation of one rotor relative to the other.

The improvement resides in the profiles of both the leading and trailing flank portions of the female rotor groove being defined by first and second circular arc portions formed by first and second radii within the addendum and dedendum portions of the lobes, respectively providing smooth uninterrupted surfaces starting below the pitch circle and terminating at or near the outside diameter of the rotor with the points of tangency of the arcs formed by the first and second radii occurring at the points of zero sliding with the male rotor at the pitch circle.

Further the length of the female rotor addendum is equal to less than one percent of the male rotor outside diameter.

Further, the first radii within the addendum portions of the lobes, are smaller than the second radii, within the dedendum portions of the lobes, with the first radii, within the addendum portions of the lobes, being tangent to the outside circle of the female rotor.

The effect of this is is that the female rotor lobe leading flank facilitates male rotor drive of the female rotor and that the female rotor lobe trailing flank facilitates female drive of the male rotor. This also results in minimized leading and trailing side blowholes formed between male and female screw rotors. The leading side blowholes occur on the intake side of the screw rotor machine, while the trailing side blowholes occur on the discharge side of the screw rotor machine. Further, the respective centers of the first and second radii on both leading and trailing groove flanks lie inside the pitch circle of the female rotor resulting in positive pressure angles between male and female rotors and improved cutting conditions.

For such female rotor the main peripheral surface of each female rotor lobe may be defined by a true circular arc centered on the female rotor axis. This results in minimized blowholes on both leading and trailing sides and provides smooth uninterrupted bearing surfaces in applications where the female rotor outer diameter and the stator or housing rotor bores act as bearings.

The invention has further application to a male rotor for such screw rotor machines in which the elongated, formed male rotor is rotatable about a central longitudinal axis and has a pitch circle centered on the axis. A plurality of elongated helical lobes extend longitudinally of the male rotor and circumferentially spaced about the pitch circle so as to provide intervening grooves therebetween, and a major portion of each of the lobes extends generally radially outwardly from the pitch circle. The profile of each of the lobes in a plane perpendicular to the axis has a tip portion and respective generally convex landing and trailing flank portions extending intermediate the tip portion and the root portion of the respective adjacent grooves.

The improvement resides in the male rotor lobe leading and trailing flank addendum portions being travel generated by the second or dedendum radii on the leading and trailing groove flanks of the female rotor. This results in effective driving surfaces on the driving and driven flanks of male and female rotors and further results in minimized blowhole areas on the intake and discharge sides of the screw rotor machine.

Further, the male rotor tip land surface may be defined by a circular arc subscribed by a radius whose center is located on the male rotor axis.

The invention is further directed to a pair of such male and female helical rotors for a screw rotor machine in the form described previously.

DESCRIPTION OF THE PREFERRED EMBODIMENT

Figure 1:
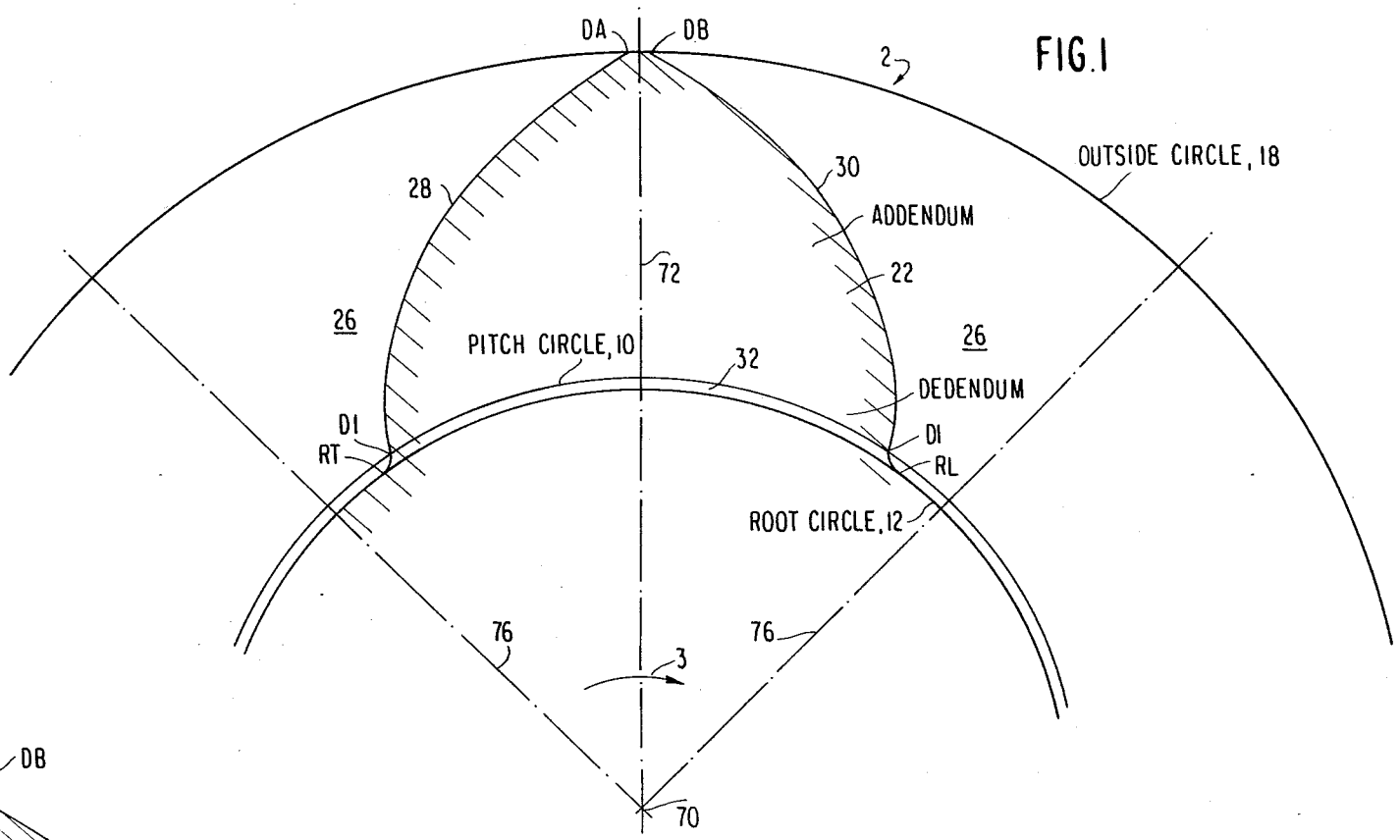
FIG. 1 is a fragmentary cross-sectional view in the plane of rotation of the male rotor constructed in accordance with the present invention.
Figure 2:
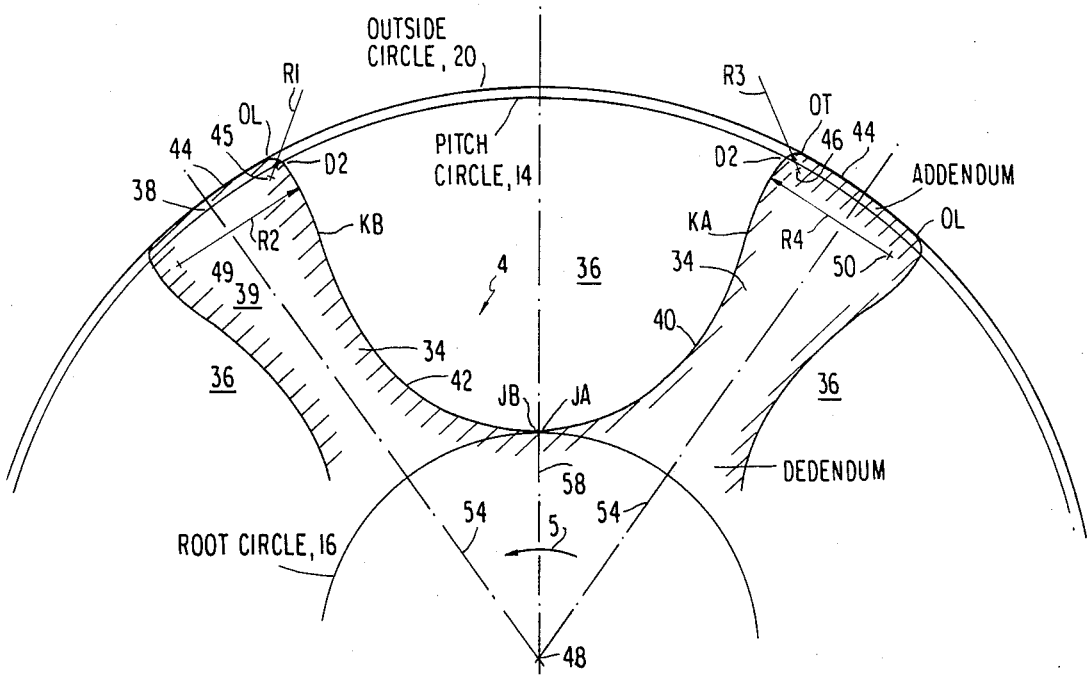
FIG. 2 is a fragmentary cross-sectional view taken in the plane of rotation of a female rotor constructed in accordance with the present invention.
Figure 3:
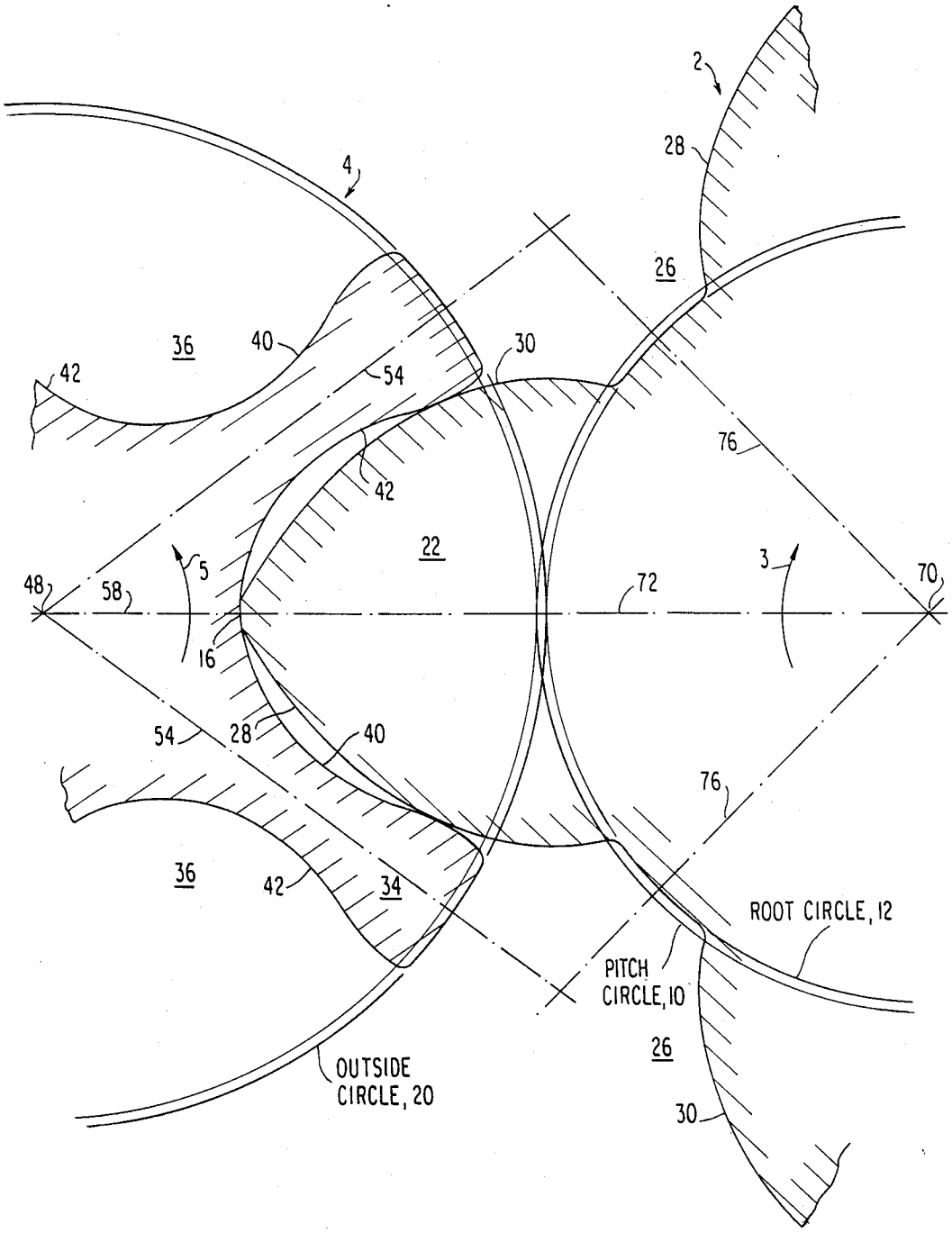
FIG. 3 is a cross-section in the plane of rotation of a pair of intermeshed rotors in accordance with FIGS. 1 and 2.

In FIGS. 1 and 2, there are shown, in transverse section relative to the axis of the rotors, the profiles of a male helical screw rotor, indicated generally at 2, and a helical screw female rotor, indicated generally at 4, respectively. Further, the profiles illustrated in FIG. 1, a single complete rotor lobe and, in FIG. 2, female rotor lobe halves defining a groove therebetween. As may be appreciated, in customary practice, the profiles are described by outlining the method by which the profiles are developed over their complete exterior surface.

In the development of the rotor profiles, the operating parameters of the screw machine whether acting as a compressor or expander are initially determined. In the illustrated embodiment, the male rotor 2 drives female rotor 4, as per arrows 3 and 5, respectively, FIGS. 1 and 2. The outside diameters of the rotors and the center distance between the rotors which are intermeshed, and which rotate within respective rotor bores (not shown) are defined. The pitch diameters of the male and female rotors 2 and 4 are calculated, and the related root diameters are derived from the relationship to the outside diameters of the mating rotors.

The pitch circle for the male rotor 2 is indicated at 10 and the root circle at 12. For the female rotor 4, the pitch circle is indicated at 14 and the root circle at 16. Male rotor 2 has lobe center lines at 72 and groove center lines at 76, respectively. As may be appreciated, the lobe thickness of the female rotor on the pitch circle is set at a predetermined value to provide suitable thermal conductivity and the necessary mechanical strength to avoid deformation or destruction under the forces of compression. The outside diameter circle or outside circle is indicated at 18 for male rotor 2, and at 20 for female rotor 4. The radially projecting lobes or lands 22 of the male rotor 2 form grooves 26 therebetween. The male rotor lobes 22 are provided with addendums 33 located radially outside of the pitch circle 10 and dedendums 32 located radially inside the pitch circle 10.

With the male rotor 2 having four helical lobes 22 and intervening grooves 26, the lobes 22 have a wrap angle of about 300 degrees.

In corresponding fashion, the female rotor 4 which has its center or axis at 48 and which has its five helical lobes or lands 34 separated by the intervening grooves 36. Each lobe has a center line 54 and each groove has a center line 58. The female rotor lobes 34 are provided with addendums 38 located radially outside of the pitch circle 14, while the male rotor has dedendums 32 located inside the pitch circle 10 of that rotor. The female lobes are completed by dedendums 39, inside the pitch circle 14. Each of the flanks 40, 42 extend from a radially innermost root portion "JA-JB" of the groove 36 out to the crest portions 44 of the respective adjacent lobes 34.

Similarly, for the male rotor 2, each of the lobe flanks 28, 30 extend from a radially innermost bottom or root portion "RL-RT" of the male root groove 26 out to the crest points "DA" and "DB" of lobes 22.

The present invention includes as a very important aspect of the rotor profile for the female rotor 4, the utilization of two radii defining both the female leading flank 42 and the female trailing flank 40 to form smooth uninterrupted surfaces on both the leading and trailing flanks, running from points "OL" and "OT" at the outside diameter or outside circle 20 through the the pitch circle 14 to points "KB" and "KA" respectively. The first leading flank portion, "OL-D2", of the two surface portions defined by these two radii, extends in the form of a circular arc subscribed by a radii "R1" and whose center of radius 45 lies inside the pitch circle 14. The second, leading flank portion, "D2-KB" is created by subscribing an arc, via radius "R2" whose center 49 also lies inside the pitch circle 14. The effect of this is to provide a smooth uninterrupted convex surface portion by blending the circular arcs produced by the radii "R1" and "R2", with the point of tangency of the arcs formed by both radii "R1", "R2" occurring at point "D2" of "zero" sliding on the pitch circle 14. Female rotor leading flank dedendum portion "JB-KB" is generated by point "DB" at the intersection of the male rotor lobe leading flank addendum 33, and the outside circle 18 of the male rotor 2. Further, the female groove leading flank portion "OL-KB" smoothly blends with the male rotor generated surface portion "JB-KB" of leading flank 40, at point "KB". The first trailing flank portion, "OT-D2" of the two surface portions defined by these two radii, extends in the form of a circular arc subscribed by a radius "R3 whose center of radius 46 lies inside the pitch circle 14. The second trailing flank portion, "D2-KA" is created by subscribing an arc via radius "R4" whose center 50 also lies inside the pitch circle 14. Centers 46 of radius R3 and 50 of radius R4 are located on line 55 which intersects female trailing flank 40 at point D2 where it intersects pitch circle 14 as shown in FIG. 2. Radius R3, within the addendum portion 38 of the trailing flank 40, is smaller than radius R4, within the dedendum portion 39 of the trailing flank 40, with radius R3 being tangent to outside diameter circle 20 of the female rotor. The effect of this is to provide a smooth uninterrupted convex surface portion by blending the circular arcs produced by the radii "R3" and "R4", with the point of tangency of the arcs formed by both radii "R3", "R4" occuring at point "D2" of "zero" sliding on the pitch circle 14. Further, rotor trailing flank dedendum portion "JA-KA" is generated by point DA at the intesection of the male rotor lobe trailing flank addendum 33, and the outside diameter circle 18. Further, the female groove trailing flank portion "OT-KA" smoothly blends with the male rotor generated portion "JA-KA" of the trailing flank 40, at point "KA".

Additionally, as will be seen, hereinafter, the radius "R3" on the female rotor trailing groove flank and the addendum radius "R1" on the female rotor groove leading flank generate generally concave surfaces "D1-RT" and "D1-RL" on the male rotor lobe trailing and leading flank dedendum portions.

The main perpheral surface 44 is defined by a circular arc swung from the axis 48 of the female rotor 4 and extending from point OT to point OL as shown in FIG. 2. This results in minimized blowholes on both flanks and provides smooth bearing surfaces in situations where the female rotor outer diameters and the housing bores act as bearing surfaces in the screw rotor machine.

Female root portion "JA-JB" is generated by male tip land portion "DA-DB".

The present invention includes as a very important aspect of the rotor profile for the male rotor leading flank 30, addendum portion "DB-D1" which is travel generated by leading flank 42, dedendum radius R2, portion "KB-D2" of the female rotor. Male rotor leading flank 30, dedendum portion "D1-RL" is generated by leading flank 42, addendum radius R1, portion "OL-D2" of the female rotor. This results in more effective driving surfaces on flanks, 30 of the male rotor and 42 of the female rotor under conditions where the male rotor is the driving member and the female rotor is the driven member and also results in effective sealing surfaces between male and female rotors and minimized blowholes on the intake side of the screw rotor machine.

Male rotor 2 trailing flank 28, addendum portion "DA-D1" is travel generated by trailing flank 40, dedendum radius R4, portion "KA-D2" of the female rotor. Male rotor 2 trailing flank 28, dedendum portion "D1-RT" is generated by trailing flank 40, addendum radius R3, portion "OT-D2" of the female rotor.

This results in more effective driving surfaces on flanks 40 of female rotors and 28 of male rotors under conditions where the female rotor is the driving member and the male rotor is the driven member and also results in effective sealing surfaces between female and male rotors and a minimized blowhole on the intake side of the screw rotor machine.

Male rotor root portion "RT-RT" is defined by a circular arc swung from male rotor axis 70.

Male rotor tip portion "DA-DB" is defined by a circular arc swung from male rotor axis 70.

Figure 1A:
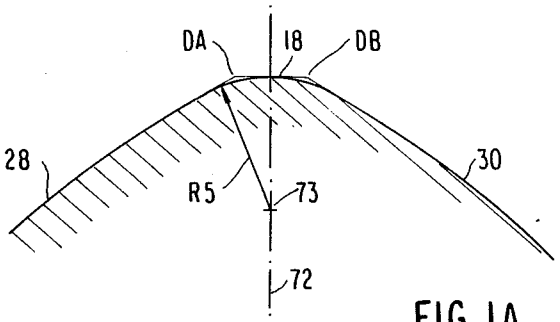
FIG. 1*a* is an enlarged cross-sectional view of the tip portion of the male rotor shown in FIG. 1.

Corresponding to female rotor 4, male rotor 2, instead of having sharp tip points "DA" and "DB" may have its profile modified in this area to provide a small circular arc described by a radius tangent to leading and trailing flanks and to the male rotor outside diameter. This is shown in FIG. 1A and in the embodiment illustrated radius R5 is tangent to leading flank 30, trailing flank 28 and outside circle 18. In FIG. 1A radius R5 has its center 73 located on center line 72. It must be appreciated, however, that center 73 of radius R5 may be located on either side of center line 72, depending upon the relative positions and lengths of radii R2 and R4 of the female rotor. The embodiment shown facilitates screw rotor operating and cutting conditions and provides flexibility of the rotor profile under conditions which do not adversely affect screw rotor machine efficiency.

The respective centers of the first and second radii on the leading and trailing flank portions of the female rotor, (R1, R2, R3 and R4) lie inside the pitch circle at positions along lines which intersect the pitch circle at points on both leading and trailing flanks so as to create active pressure angles between operating male and female rotors of 10 to 20 degrees resulting in improved cutting conditions.

The profiles shown and described are reproducible over the wide range of rotor sizes employed in actual practice. The invention has application to intermeshed helical screw rotors having a greater or lesser number of lobes. Both rotors may have their pitch diameters, and center distance vary as needed.

While the invention has been particularly shown and described with reference to a preferred embodiment thereof, it will be understood by those skilled in the art that various other changes in form and details may be made therein without departing from the spirit and scope of the invention.

What is claimed is:

1. An elongated female rotor for a screw rotor machine having an intake side and a discharge side; a male rotor, and a housing including housing bores for said female rotor and said male rotor; said elongated female rotor being rotatable about a central axis and having a pitch circle centered on said axis, having an outer diameter and comprising;

a plurality of elongated helical lobes extending longitudinally of said rotor and circumferentially spaced about said pitch circle so as to provide intervening grooves therebetween forming addendum portions outside the pitch circle and dedendum portions inside the pitch circle; said elongated female rotor being rotatable about a central axis, having a pitch circle centered on said axis and having an outer diameter;

a major portion of each of said lobes extending radially inwardly of said pitch circle;

the profile of each of said lobes in a plane perpendicular to said axis having a tip portion and respective generally concave leading and trailing flank portions extending intermediate said tip portion and a root portion of the respective adjacent groove;

and wherein said lobes of said female rotor engage grooves of said male rotor defined by corresponding helical male rotor lobes with contact between flank portions of respective female and male rotors during rotation of one rotor relative to the other;

the improvement wherein the profile of the leading flank portion of each female rotor lobe is defined by first and second circular arc portions subscribed by first and second radii within the addendum and dedendum portions of said lobe, respectively, providing a smooth uninterrupted surface, starting below the pitch circle and terminating at the outside circle of the rotor with the point of tangency of the arcs formed by the first and second radii occurring at a point of zero sliding with the male rotor on said pitch circle;

whereby, said female leading flank surface portions facilitate male drive of the female rotor and reduction in blowholes formed between the female and male screw rotor leading flanks on the intake side of the screw rotor machine.

2. The female rotor for a screw rotor machine as claimed in claim 1 wherein the main perpheral surface of each female rotor lobe is defined by a circular arc swung from the axis of the female rotor resulting in minimized blow holes on both leading and trailing flanks and providing smooth bearing surfaces under conditions where the female rotor outer diameter and the housing bores act as bearings.

3. The female rotor as claimed in claim 1, wherein respective centers for first and second leading flank radii are inside the pitch circle.

4. The female rotor as claimed in claim 1, wherein the respective centers of first and second trailing flank radii are inside the pitch circle.

5. A female rotor for a screw rotor machine as claimed in claim 1 wherein the trailing flank portion of said female rotor has a profile defined by first and second circular arc portions subscribed by first and second radii within the addendum and dedendum portions of each lobe, respectively, and wherein the first radius within the addendum portion of each lobe is smaller than the second radius within the dedendum portion of each lobe with the first radius being tangent to the outside circle of the rotor, providing smooth uninterrupted surfaces, starting below the pitch circle and terminating at the outside circle of the rotor with the point of tangency of the arcs formed by the first and second radii occurring at a point of zero sliding with the male rotor on said pitch circle;

whereby said female trailing flank surface portions facilitate female drive of the male rotor and reduction in blowholes formed between the male and female screw rotors on trailing flanks on the discharge side of the screw rotor machine.

6. The female rotor as claimed in claim 5, wherein the respective centers of the first and second radii on the leading and trailing flank portions of the female rotor, (R1,R2 R3 and R4) lie inside the pitch circle at positions so as to create active pressure angles between operating male and female rotors of 10 to 20 degrees resulting in improved cutting conditions.

7. An elongated formed male rotor for a screw rotor machine further including a female rotor, a housing including housing bores for said female rotor and said male rotor, an intake side and a discharge side, said female rotor being rotatable about a central axis and having a pitch circle centered on said axis, said female rotor further having an outer diameter and comprising a plurality of elongated helical lobes extending longitudinally of said female rotor and being circumferentially spaced about said pitch circle so as to provide intervening grooves therebetween, and forming addendum portions outside the pitch circle and dedendum portions inside the pitch circle;

a major portion of each of said lobes extending radially outwardly of the pitch circle;

the profile of each of said lobes in a plane perpendicular to said axis having a tip portion and respective, generally concave leading and trailing flank portions extending intermediate said tip portion and the root portion of the respective adjacent groove;

and wherein said lobes of said female rotor engage the grooves of said male rotor defined by corresponding helical male rotor lobes with contact between flank portions of respective female and male rotors during rotation of one rotor relative to the other;

wherein the profile of the leading flank portion of each female rotor lobe is defined by first and second circular arc portions subscribed by first and second radii within the addendum and dedendum portions of said lobe, respectively, providing a smooth uninterrupted surface starting below the pitch circle and terminating at the outside circle of the female rotor with the point of tangency of the arcs formed by the first and second radii occurring at a point of zero sliding with the male rotor on the pitch circle and wherein the first radius within the addendum portion of each female lobe is smaller than the second radius within the dedendum portion of each female lobe with the first radius being tangent to the outside circle of the rotor; whereby, the female rotor leading flank surface portions facilitate male drive of the female rotor and reduction in blowholes formed between the female and male rotor leading flanks on the intake side of the screw rotor machine, said elongated formed male rotor being rotatable about a central longitudinal axis and having a pitch circle centered on said axis; said male rotor comprising a plurality of elongated helical lobes extending longitudinally of said male rotor and circumferentially spaced about the pitch circle so as to provide intervening grooves therebetween; a major portion of each of said male rotor lobes extending generally radially outwardly from said male rotor pitch circle; the profile of each of said male rotor lobes in a plane perpendicular to said axis having a tip portion and respective generally convex leading and trailing flank portions extending intermediate said tip portion and the root portion of the respective adjacent grooves;

the improvement wherein said male rotor leading flank addendum portion is travel generated by said second, dedendum radius on the leading flank of said female rotor resulting in more effective driving surfaces on the flanks of male and female rotors under conditions where the male rotor is the driving member and the female rotor is the driven member and also results in the creation of effective sealing surfaces between male and female rotors and a minimized blowhole on the intake side of the screw rotor machine.

8. The male rotor as claimed in claim 7 wherein the trailing flank portion of the female rotor has profile defined by first and second circular arc portions subscribed by first and second radii within the addendum and dedendum portion of each female rotor lobe, respectively, and wherein the first radius within the addendum portion of each female rotor lobe is smaller than the second radius within the dedendum portion of each female rotor lobe with the first radii being tangent to the outside circle of the female rotor, providing smooth uninterrupted surfaces starting below the pitch circle and terminating at the outside circle of the female rotor with the point of tangency of the arcs formed by the first and second radius occurring at a point of zero sliding with the male rotor on said pitch circle; whereby said female rotor trailing flank surface portions facilitate female rotor drive of the male rotor and reduction in blowholes formed between the male and female screw rotors on the trailing flanks thereof on the discharge side of the screw rotor machine and wherein the male rotor lobe trailing flank addendum portions are travel generated by the second, dedendum radius on the trailing groove flank of the female rotor resulting in more effective driving surfaces on the flanks of the female and male rotors under conditions where the female rotor is the driving member and the male rotor is the driven member and also resulting in the creation of effective sealing surfaces between male and female rotors and a minimized blowhole on the discharge side of the screw rotor machine.

9. The male rotor as claimed in claim 8, wherein the male rotor lobe has its tip portion defined by a small circular arc prescribed by a radius tangent to both leading and trailing flanks and to the outside circle, thereby facilitating machining and cutting conditions and providing flexibility to the rotor profile without adversely affecting screw rotor machine efficiency.

10. A pair of helical screw male and female rotors for a screw rotor machine comprising:

a casing having bores receiving respectively said male rotor and said female rotor for rotation of said rotors about respective parallel axes for intermeshing counter-rotation of said male and female rotors, said male rotor being rotable about a central longitudinal axis and having a pitch circle centered on such axis, a plurality of elongated helical male rotor lobes extending longitudinally of said male rotor and circumferentially spaced about said pitch circle so as to provide intervening grooves therebetween, and lobe addendum portions outside of said pitch circle and lobe dedendum portions inside said pitch circle, said male rotor having an outside circle radially beyond said pitch circle, a major portion of each of said male rotor lobes extending generally radially outwardly from said pitch circle, the profile of each of the male rotor lobes in a plane perpendicular to the axis having a tip portion and respective, generally concave male rotor lobe leading and trailing flank portions extending intermediate said tip portions and the root of the respective adjacent male rotor grooves, said female rotor being rotatable about a central axis and having a female rotor pitch circle centered on said axis and having an outside circle and comprising a plurality of elongated female rotor helical lobes extending longitudinally of said female rotor and circumferentially spaced about said female rotor pitch circle so as to provide intervening female rotor grooves therebetween forming female rotor groove portions outside the pitch circle and dedendum portions inside the pitch circle;

a major portion of each of said female rotor lobes extending radially intermediate of the pitch circle of the female rotor pitch circle;

wherein the lobes of the female rotor engage the grooves of the male rotor defined by corresponding helical male rotor lobes with contact between the flank portions of respective female and male rotors during rotation of one rotor relative to the other, the improvement wherein the profile of the leading flank portion of each female rotor lobe is defined by first and second circular arc portions subscribed by first and second radii within the addendum and dedendum portions of said female rotor lobe, respectively, providing a smooth uninterrupted surface starting below the female rotor pitch circle and terminating at the outside circle of the female rotor with the point of tangency of the arcs formed by the first and second radii for each female rotor lobe leading flank portion occurring at a point of zero sliding with the male rotor on said female rotor pitch circle and wherein the first radius within the addendum portion of each female rotor lobe is smaller than the second radius within the dedendum portion of each female rotor lobe with the first radius being tangent to the outside circle of the rotor;

whereby said female leading flank surface portions of said female rotor facilitate male drive of the female rotor and reduction in blowholes formed between the male and female leading flanks on the intake side of the screw rotor machine;

wherein the profile of said male rotor leading flank addendum portion is travel generated by the second, dedendum radius on the leading flank of the female rotor lobes, resulting in a more effective driving surface on the flanks of the male and female rotors under conditions where the male rotor is a driving member and the female rotor is a driven member while resulting in the creation of effective sealing surfaces between the male and female rotors and a minimized blowhole on the intake side of the screw rotor machine, and wherein;

the male rotor trailing flank addendum portion is travel generated by the second, dedendum radius on the trailing flank of the female rotor on the trailing flank of each lobe of the female rotor resulting in more effective driving surfaces on the flanks of the female and male rotors under conditions where the female rotor is a driving member and the male rotor is the driven member while resulting in the creaction of effective sealing surfaces between female and male rotors and a minimized blowhole on the discharge side of the screw rotor machine.

* * * * *